United States Patent [19]

Crawford et al.

[11] Patent Number: 4,727,911

[45] Date of Patent: Mar. 1, 1988

[54] LOOM TAKE-UP TRAY

[75] Inventors: James D. Crawford; Richard A. Rubel, both of McCormick, S.C.

[73] Assignee: Milliken Research Corporation, Spartanburg, S.C.

[21] Appl. No.: 77,954

[22] Filed: Jul. 24, 1987

Related U.S. Application Data

[63] Continuation of Ser. No. 45,422, May 4, 1987, abandoned.

[51] Int. Cl.[4] ..... D03D 49/20

[52] U.S. Cl. ..... 139/304; 26/70

[58] Field of Search ..... 66/149 R; 139/304, 307, 139/308, 309, 1 C; 26/70; 242/67.1 R, 67.2, 67.3 R

[56] References Cited

U.S. PATENT DOCUMENTS

| | | | |
|---|---|---|---|
| 196,471 | 10/1877 | Morrill . | |
| 807,891 | 12/1905 | Weathers . | |
| 1,248,542 | 12/1917 | Pope . | |
| 2,371,771 | 3/1945 | Morse . | |
| 2,660,269 | 11/1936 | Wikle . | |
| 2,811,176 | 10/1957 | Mangum | 139/304 X |
| 3,342,433 | 9/1967 | Klaczkiewicz . | |
| 3,474,980 | 10/1969 | Mann, Jr. . | |
| 3,501,106 | 3/1970 | Case . | |
| 3,677,305 | 7/1972 | Cutting et al. | 139/304 X |
| 4,633,914 | 1/1987 | Carry | 139/304 X |

*Primary Examiner*—Henry S. Jaudon

*Attorney, Agent, or Firm*—Earle R. Marden; H. William Petry

[57] ABSTRACT

A loom with an off-loom take-up which employs a loom tray between the loom and the take-up to prevent the woven fabric from falling onto the weave room floor but which allows trash and dirt to pass through. The loom tray coprises a substantively rectangular frame with a mesh construction connected thereto with sufficient openness to allow trash and dirt to fall through.

6 Claims, 2 Drawing Figures

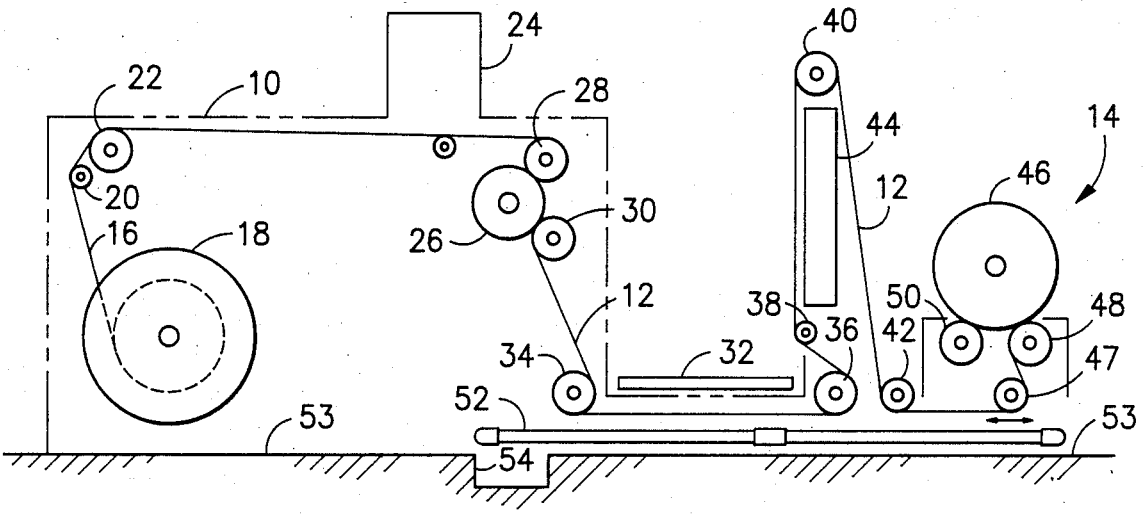
FIG. — 1 —
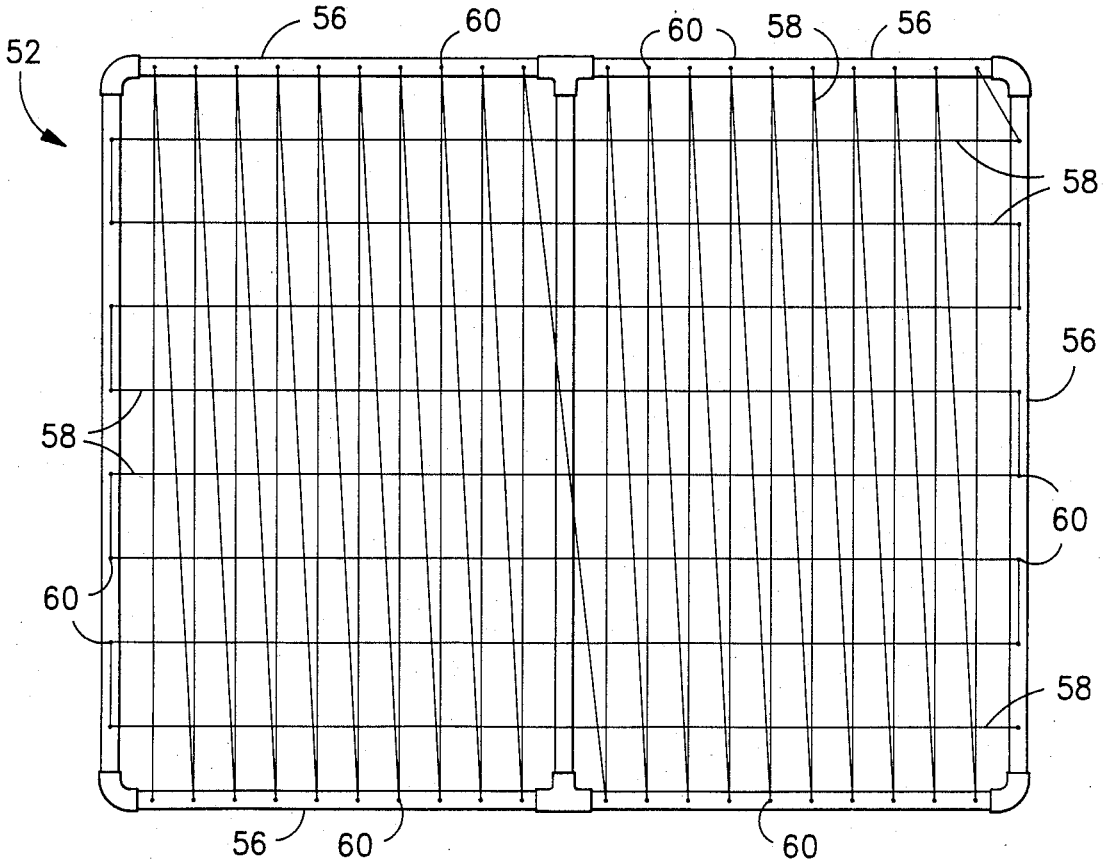
FIG. — 2 —

LOOM TAKE-UP TRAY

This is a continuation of application Ser. No. 045,422 filed 05/04/87, now abandoned.

This invention relates generally to looms and more particularly to looms having an off-loom take-up causing the woven fabric to be transported a considerable distance closely adjacent the floor of the weave room.

It is therefore an object of the invention to provide a new and novel loom take-up tray under the path of travel of woven fabric from the loom to the off-loom take-up apparatus.

Other objects and advantages of the invention will become readily apparent as the specification proceeds to describe the invention with reference to the accompanying drawing, in which:

FIG. 1 is a schematic representation of the loom and the off-loom take-up with the novel loom tray in position, and FIG. 2 is a top view of the new and novel loom take-up tray shown schematically in FIG. 1.

Prior to this invention, a mold plastic tray was placed on the floor between the loom and the off-loom take-up to prevent woven fabric travelling from the loom from falling onto the floor and picking up dirt therefrom. This could occur when the tension in the fabric allowed the fabric to sag or when the loom and take-up were shut down for doffing. These plastic trays worked while clean but tended to sag in the middle after use and accumulated the same trash and dirt as the floor which necessitated constant removal and cleaning. The herein described invention eliminates such cleaning since it automatically eliminates trash and dirt pick-up.

Looking now at FIG. 1 the invention will be explained. The reference numeral 10 represents a loom supplying a woven fabric 12 to an off-loom take-up 14. In conventional manner a sheet of warp yarn 16 is supplied from a warp beam 18 over rolls 20 and 22 to the heddle section 24 to be woven wherein the yarn 16 is woven into fabric 12. The fabric 12 from the heddle section 24 is held taut and delivered from the loom by the sand roll 26 which has press rolls 28 and 30 holding the fabric thereagainst. From the press roll the fabric 12 is guided under the inspection platform 32 by the rolls 34 and 36. From the inspection platform 32 the fabric 12, guided by rolls 38, 40 and 42 passes over the inspection lightbox 44 to the take-up roll 46. From the guide roll 42 the fabric 12 passes under the dancer roll 46 to control tension therein to the take-up roll 46 driven by surface drive rolls 48 and 50. To prevent the fabric between the rolls 34 and 46 from falling onto the floor 53 of the weave room, the loom tray 52 is provided under the area between the loom take-off and the off-loom take-up 14. Since, in the preferred form of the invention, the loom 10 is a water jet loom a water drain gutter 54 is provided in the floor 53.

As briefly described before, the loom tray 52, shown in detail in FIG. 2, consists of a rectangular frame 56 of suitable material, such as 1" PVC plastic tubing and interlaced with nylon twine 58 of suitable strength such as No. 18. The twine is strung, as shown in FIG. 2, on screws 60 screwed into the top of the frame tubing 56. In the preferred form of the invention the twine 58 is wrapped around the screw 60 in the lower left hand corner of the drawing and threaded zig-zag in the pattern shown and is held taut by wrapping the twine around the screws on each reach. When the right hand end of the frame is reached the twine is threaded transversely as shown to provide further support. The particular twine configuration is not part of the invention so long as it will support the fabric and allow trash and dirt to pass therethrough to prevent accumulation thereof.

The herein described loom invention provides an arrangement wherein an off-loom take-up can be employed without damage or soilage to the woven fabric being supplied from the loom to the take-up.

Although we have described specifically the preferred embodiment of our invention, we contemplate that changes may be made without departing from the scope or spirit of our invention and we desire to be limited only by the scope of the claims.

We claim:

1. A loom arrangement comprising: a loom to manufacture woven fabric, a fabric take-up mechanism spaced from said loom, a first means to supply fabric from said loom to said take-up mechanism and a second means located between said loom and said take-up mechanism to prevent fabric from falling on the floor of area in which said loom arrangement is located, said second means being a tray located below the line of travel of fabric from said loom to said take-up mechanism and having an open construction to allow dirt, etc. to fall through.

2. The loom arrangement of claim 1 wherein said tray comprises a substantively rectangular frame with an interlaced thread construction connected thereto.

3. The loom arrangement of claim 2 wherein said rectangular frame is comprised of plastic tubing and said thread is nylon.

4. The loom arrangement of claim 1 wherein said loom arrangement includes an inspection station between said loom and said take-up mechanism, said inspection station including a platform under which woven fabric travels to said take-up mechanism and said tray is located on the floor under said platform.

5. The loom arrangement of claim 4 wherein said tray comprises a substantively rectangular frame with an interlaced thread construction connected thereto.

6. The loom arrangement of claim 5 wherein said rectangular frame is comprised of plastic tubing and said thread is nylon.

* * * * *